United States Patent [19]

Kobayashi et al.

[11] 3,957,513

[45] May 18, 1976

[54] METHOD OF FREE RADICAL PHOTOGRAPHY UTILIZING A SHORT LIGHT FLASH FOR EXPOSURE

[75] Inventors: Hidehiko Kobayashi, Fuji; Hidesaburo Genda, Tokyo; Toshio Ishikawa, Chiba, all of Japan

[73] Assignee: Asahi Kasei Kogyo Kabushiki Kaisha, Osaka, Japan

[22] Filed: Apr. 18, 1974

[21] Appl. No.: 462,164

[30] Foreign Application Priority Data

Apr. 19, 1973 Japan ..... 48-43626
Jan. 29, 1974 Japan ..... 49-12012

[52] U.S. Cl. ..... 96/48 QP; 96/48 R; 96/90 R

[51] Int. Cl.[2] ..... G03C 5/24

[58] Field of Search ..... 96/48 R, 48 QP

[56] References Cited

UNITED STATES PATENTS

| | | | |
|---|---|---|---|
| 3,033,682 | | Hunt | 96/48 QP |
| 3,147,117 | 9/1964 | Wainer et al. | 96/48 QP |
| 3,510,300 | 5/1970 | Fotland et al. | 96/48 R |
| 3,510,304 | 5/1970 | Fichter et al. | 96/48 R |
| 3,647,448 | 3/1972 | DeMeyer et al. | 96/48 QP |
| 3,684,510 | 8/1972 | Psaar et al. | 96/48 QP |

*Primary Examiner*—David Klein
*Assistant Examiner*—Judson R. Hightower
*Attorney, Agent, or Firm*—Burgess, Dinklage & Sprung

[57] ABSTRACT

Novel method of free radical photography in which a colored image excellent in photographic properties such as gradient, resolving power, image stability, amount of fogs and contrast can be obtained while shortening the treating time and simplifying the treatment steps. The method comprises exposing a photosensitive composition comprising a film-forming transparent plastic, a compound capable of forming free radicals upon irradiation with light and a color former capable of reacting with these free radicals to produce color, to a light flash with a light quantity of 5 to 500 millijoules per square centimeter for a flashing time of 0.0001 to 0.005 second through a negative or positive original.

5 Claims, 5 Drawing Figures

METHOD OF FREE RADICAL PHOTOGRAPHY UTILIZING A SHORT LIGHT FLASH FOR EXPOSURE

This invention relates to a novel method for direct and instantaneous formation of colored images. More particularly, the invention relates to a method for direct and instantaneous formation of colored images which have an excellent gradient and a high resolving power and which are excellent in the stability with less formation of fogs or other defects, wherein a novel photosensitive composition is employed and the light exposure is effected with a flash lamp as a light source, and also relates to a system for practice of the method.

Photography using a photosensitive composition comprising a material capable of forming free radicals by the action of light and a substance capable of reacting with such free radicals to form a color is generally known as free radical photography (See, for example, Japanese Pat. Publication No. 1548/1962).

Free radical photography is generally characterized in that images can be directly formed by the light exposure and all the steps inclusive of the image-fixing step are conducted in the dry state, and that various wet treatment steps necessary for silver salt photography, such as development, fixation, water-washing and drying need not be conducted at all. By virtue of these characteristic features, in free radical photography there are attained various advantages such as shortening of the operation time, reduction of the treatment steps, non-necessity of chemicals for development and fixation and non-necessity of waste liquor treatment. However, in free radical photography, if the light exposure is effected by utilizing a light source of the continuous radiation type, it takes several seconds to scores of seconds to obtain a directly printed image because the free radical type photosensitive composition is generally inferior to an ordinary silver salt type photosensitive material with respect to sensitivity, with the result that the above advantages attained by the characteristic features of free radical photography are diminished (See, for example, Japanese Pat. Publications Nos. 1548/1962, 5115/1964, 375/1965, 2524/1969, 12821/1970, 21985/1971, etc.). As means for overcoming this defect, there has been proposed a method in which a latent image is once formed by light exposure with flash light of a small power and the latent image is thermally developed (See Japanese Pat. Publication No. 8791/1962). However, the inherent advantages of free radical photography are lessened by complicated operation conditions and increase of image-varying factors, and this proposal is further defective in that fogs are readily formed.

Further, although free radical photography is excellent in image quality, namely excellent gradient and high resolving power can be attained in free radical photography, it is inferior to photography using a silver salt type photosensitive material in respect of such points as image stability and contrast. Accordingly, free radical photography is hardly utilized except for special uses. Silver salt photography has a long history and is utilized broadly in various fields because excellent photographic properties are attained and these photographic properties can be adjusted and controlled within broad ranges by the development operation and the like. Silver salt photography, however, involves various problems such as scantiness of silver resources, necessity of wet treatment, complexity of the treatment steps, a long treatment time, disposal of waste liquor and the like. Accordingly, development of a photographic system which can give excellent image quality by simple treatment steps for a short treatment time has been greatly desired in the art.

We have made investigations with a view to developing a method of free radical photography in which the foregoing defects involved in conventional free radical photographical techniques are eliminated and at the same time the merits of free radical photography can be fully realized. It has now been found that when a photosensitive material having a specific composition is exposed to radiation of a flash light source under specific conditions, the treatment time can be unexpectedly shortened and the photographic properties can be highly improved. Based on this finding, we have now completed this invention.

It is therefore a primary object of this invention to provide a novel method of free radical photography which can give printed images of high quality excellent in such photographic properties as gradient, resolving power, image stability, the degree of formation of fogs and the like by simple treatments while shortening the treatment time greatly.

Another object of this invention is to provide a method of free radical photography of the character described, in which printed images having excellent photographic properties can be obtained by simple treatment steps for a very short time.

A still further object of this invention is to provide a system for free radical photography which is suitably used for practice of the above method of free radical photography.

Other objects, advantages and features of this invention will be apparent from the following detailed description.

In one aspect of this invention, there is provided a photsensitive composition for free radical photography which comprises a film-forming transparent plastic, a compound capable of forming free radicals upon irradiation of light and a color former capable of reacting with the free radicals to form a color.

In another aspect of this invention, there is provided a method of free radical photography which comprises exposing the above-mentioned photosensitive composition or a photosensitive material formed by coating the above photosensitive composition on an appropriate substrate to radiation or a flash light source with a light quantity of 5 to 500 millijoules per square centimeter for a flashing time of 0.0001 to 0.005 second through an original to thereby form a colored image instantaneously.

The photosensitive composition of this invention consists essentially of (a) a film-forming transparent plastic (hereinafter referred to as "binder"), (b) a compound capable of forming free radicals by the action of light (hereinafter referred to as "photo-activator") and (c) a color former capable of reacting with the free radicals to form a color. The photosensitive composition of this invention may further comprise photographic additives generally used in this field, such as stabilizer, sensitizers, plasticizers and the like, according to need.

As the binder to be used in this invention, there can be mentioned, for example, polyvinyl chloride, polystyrene, ethylcellulose, acetylcellulose, nitrocellulose, polyvinylidene chloride, acrylic rubber, butadiene copolymers, polymethyl methyacrylate, polyvinyl acetate, styrene-maleic anhydride copolymers and the like.

As the photo-activator to be used in this invention, there can be mentioned, for example, halogen-containing organic compounds such as $CBr_4$, $CI_4$, $CHI_3$, $CHBr_3$, $C_2Cl_6$, $C_2HBr_5$, $C_2Br_6$, $C_6H_5CBr_3$, $C_6H_5CCl_3$, chloral, bromal, tribromoacetamide, 2,2,2-tribromoethanol, $\alpha,\alpha,\alpha$-tribromoacetophenone, p-nitro-$\alpha,\alpha,\alpha$-tribromoacetophenon, 1,3-benzenedisulfonyl chloride, o-nitrobenzenesulfonyl chloride, p-bromobenzenesulfonyl chloride, p-toluenesulfonyl chloride, benzenesulfonyl bromide, 2,4-dinitrobenzenesulfonyl chloride, o-nitrobenzenesulfonyl chloride, $\omega,\omega,\omega$-tribromoquinaldine, 2-$\omega,\omega,\omega$-tribromomethyl-4-methylquinoline, 4-$\omega,\omega,\omega$-tribromomethylpyrimidine, 2-$\omega,\omega,\omega$-tribromomethyl-6-nitrobenzenethiazole, 1-phenyl-3-$\omega,\omega,\omega$-tribromomethylpyrazol, 1-methyl-2-chloromethylbenzimidazole, 2,5-di-(tribromomethyl)3,4-dibromothiophene, hexabromodimethylsulfoxide, hexabromodimethylsulfone, tribromomethylphenylsulfone, tetrabromodimethylsulfone, 2,4-dichlorophenyltrichloromethylsulfone, 2-tribromomethyl-sulfonyl-6-methoxybenzothiazole, 1-methyl-2-tribromomethylsulfonylbenzimidazole, 2-methylbenzthiazole, ethylbromide and the like.

As the color former, there can be employed arylamines and phenols. In addition to ordinary arylamines such as primary, secondary and tertiary aromatic amines, there can be employed reduction products of dyes having a substituted or unsubstituted amino group, namely so-called leuco dyes. As representative examples of color formers to be used in this invention, there can be mentioned, N,N-diethylaniline, N,N-diethanolaniline, N-phenyl-$\alpha$-naphthylamine, N-phenyl-$\beta$-naphthylamine, diphenylamine, N-vinylcarbazole, triphenylamine, 1,2-dianilinoethylene, N-vinylindole, o-toluidine, 2-methylindole, 2-phenylindole, indole, 3-phenylindole, 3-aminoquinoline, salicylidene-p-toluidine, N,N-diphenyl-p-phenylene diamine, N,N'-di-($\beta$-naphthyl)-p-phenylene diamine, N-phenyl-N'-cyclohexyl-p-phenylene diamine, N,N'-diphenyl-m-phenylene diamine, N-isopropyl-N'-phenyl-p-phenylene diamine, 3,7-di-tert-octylphenothiazine, 3,7-di-tert-octylphenoxazine, phenothiazine, phenoxazine, 3,7-diphenylphenoxazine, diphenylamine-acetone condensate, N-phenyl-$\alpha$-naphthlamine-acetone condensate, N-phenyl-$\beta$-naphthylamine-acetone condensate, N,N'-diphenyl-p-phenylene diamine-acetone condensate, ring-opened polymers of 2,2,4-trimethyl-1,2-dihydroquinoline, 1-($\alpha$-naphthylimino)-3-hydroxybutane, 1-($\beta$-naphthylamino)-3-hydroxybutane, N,N-di-(3-hydroxy-1-butenyl)-$\alpha$-naphthylamine, N,N-di-(3-hydroxy-1-butenyl)-$\beta$-naphthylamine, Leuco Opal Blue, Leuco Crystal Violet, Leuco Malachite Green, Leuco Victoria Blue, Leuco Methyl Violet, Leuco Rosaniline, 3,6-bis(dimethylamine)-9-(p-dimethylaminophenyl)-xanthene, 2,7-bis(dimethylamino)-10-p-methylaminophenyl-9,10-dihydro-9,9-dimethylanthrathene, 2-methylinodole-benzaldehyde condensate, 2-phenylindolecinnamic aldehyde condensate, 1,1-bis(p-methylaminophenol)-p'-dimethylaminophthalan, 10-benzoyl-3,7-di-(p-dimethylamino)-phenothiazine, 3-diethylamino-7-aminophenoxzine, $\alpha$-naphthol, $\beta$-naphthol, 5-amino-2-naphthol, 8-amino-2naphthol, 2,6-dimethylphenol and the like. These color formers can be used singly or in the form of mixtures of two or more of them.

In addition to the foregoing binder, photo-activator and color former, the photosensitive composition of this invention may comprise other photographic additives, according to need. The photosensitive composition of this invention is dissolved or dispersed in an appropriate solvent, for example benzene, toluene, dimethylformamide, etc. and the resulting solution or dispersion is coated and dried on the surface of a support or a substrate to form one or more layers of the photosensitive composition. Thus, a photosensitive material for use in free radical photography can be obtained. At this time, as the substrate there can be employed, for example, paper, film, plastics, woven fabrics, metal plates and the like. A suitable substrate is chosen depending on the object, the intended use and the like. Formation of a photographic image on the so formed photosensitive material can be accomplished by exposing the surface of the photosensitive material to radiation of a suitable flashlight source through a negative or positive original to be reproduced. In respect of the preparation of the photosensitive composition from the components and the method of coating the composition onto the substrate, the known customary method may be employed (See, for example German Auslegeschrift No. 2162895 and Publication of Dutch pat. application No. 7117109).

In the light-exposure of the photosensitive material of this invention, most preferred results can be obtained when a flash light source such as a xenon lamp is used as the light source and the light exposure is conducted under such conditions as a flashing time of 0.0001 to 0.005 second as expressed in terms of the half value (which will be mentioned later) and an effective light quantity of 5 to 500 millijoules per square centimeter.

More specifically, if the light exposure is conducted under the above conditions, a printed image is instantaneously formed and the image density (namely, the sensitivity of the photosensitive material) and image contrast can be highly improved with reduction of fogs, as compared with the conventional techniques based on the same light quantity. In case the flashing time is shorter than 0.0001 second, the contrast is reduced, and when the flashing time is longer than 0.005 second, the sensitivity and the degree of occurrence of fogs approximate those obtained when a light source of the continuous, radiation type is employed and the effect by use of a flashlight source is lowered.

The quantity of light for exposure varies depending on the original, the kind of the photosensitive composition, the coating thickness of the photosensitive composition and other factors. However, in general, when the photosensitive composition of this invention for free radical photography is exposed to a light flash of a quantity smaller than 5 millijoules per square centimeter, the contrast as well as the image density is insufficient, and if the quantity of light for exposure is larger than 500 millijoules per square centimeter, fogs are formed in the high-light portion of the printed image because of excesssive exposure.

A clear image can be directly printed by the above procedures according to this invention. Further, it is noted that, in order to obtain a better print, the so obtained image may advantageously be stabilized by conducting the thermal fixation for 0.2 to 10 minutes in an atmosphere maintained at 80° to 180°C.

The free radical photographic method of this invention and a system for the free radical photography which is utilized suitably for practice of this invention will now be illustrated by reference to the accompanying drawings, in which.

Figure 1:
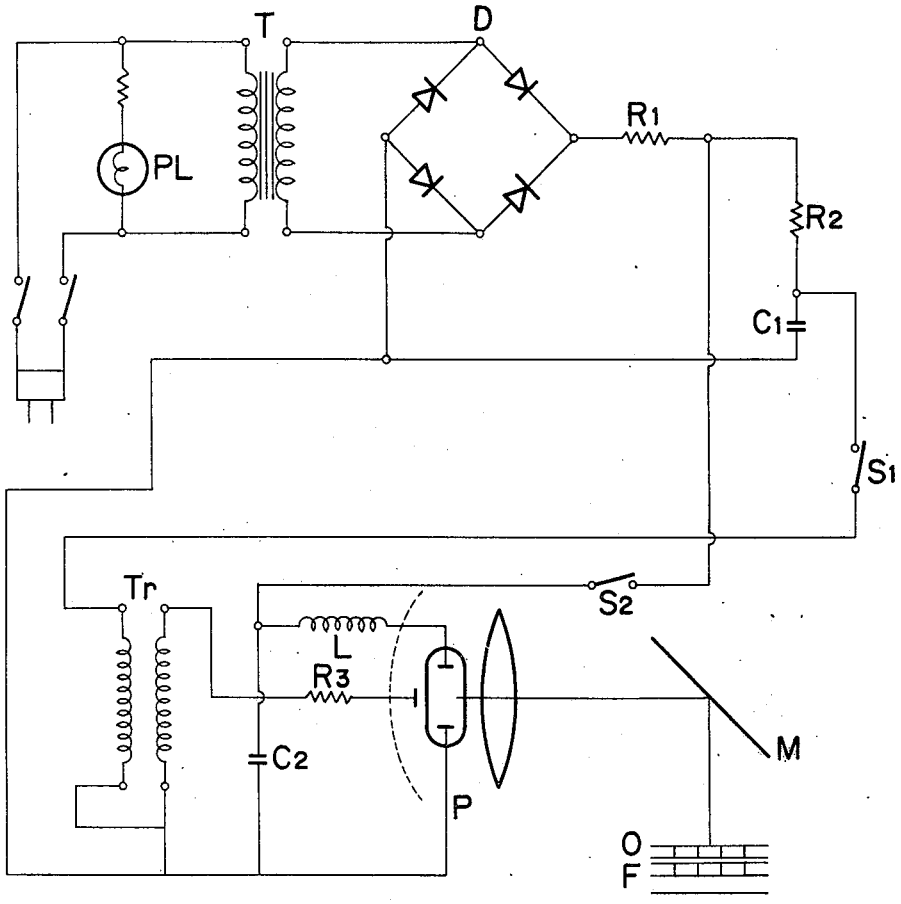
FIG. 1 is a circuit diagram of a system for free radical photography in which one flash lamp is employed.

Referring to FIG. 1 illustrating a circuit of an embodiment of a system suitable for practice of the free radical photographic method of this invention, in which one flash lamp is employed, an alternating current of a high voltage is rectified by a bridge rectifier D and is accumulated in an exciting condenser $C_1$ and an illuminating condenser $C_2$. At the time of light exposure, the trigger excitaton is caused by a trigger coil Tr and a flash lamp P is thereby actuated. In FIG. 1, T is a high voltage transformer, each of $R_1$, $R_2$ and $R_3$ is a resistance, each of $S_1$ and $S_2$ is a high voltage switch, and L is a coil. Flashlight emitted from the flash lamp P is concentrated by a condensing lens system such as a combination of a concave mirror and a quartzlens, and the concentrated light is irradiated over the photosensitive material F through a negative or positive original O. In the foregoing manner, contact printing can be performed simply. If the condensing lens system is appropriately modified, it is possible to obtain enlarged printed images.

In the embodiment illustrated in FIG. 1, one flash lamp is employed. In this invention, however, it is possible to employ a system in which a plurality of flashlight lamps connected in parallel. Such embodiment is shown in FIG. 2.

Figure 2:
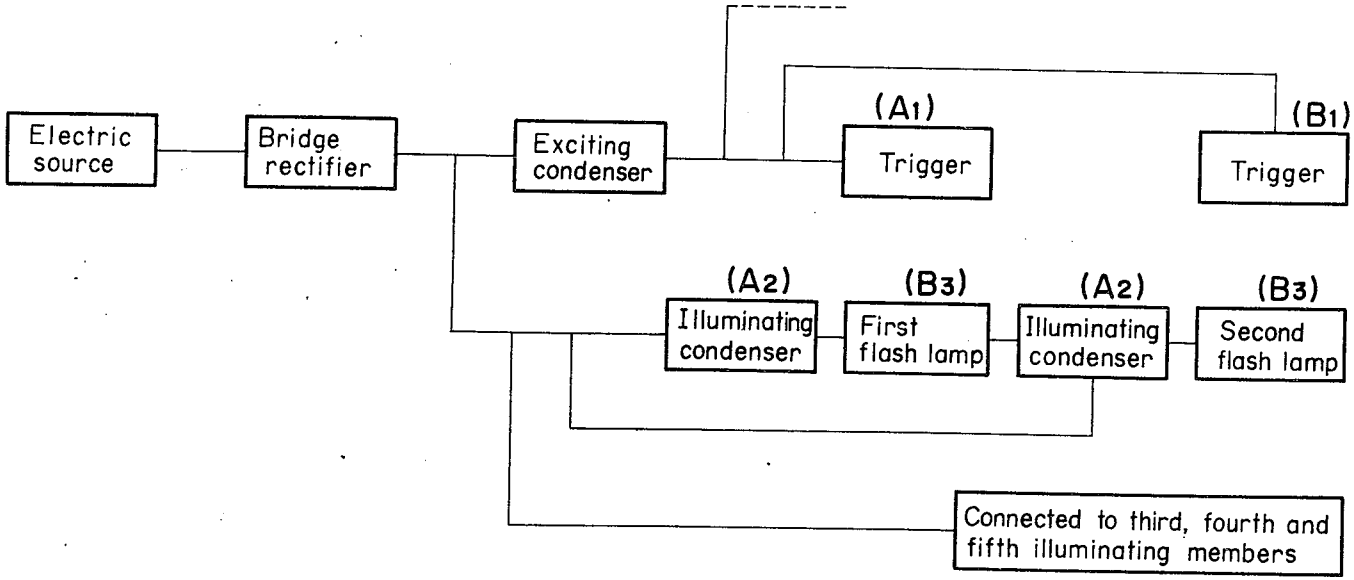
FIG. 2 is a block diagram of a system for free radical photography in which a plurality of flash lamp units are connected in parallel.

In FIG. 2, a first flash light lamp unit comprising a trigger $A_1$, an illuminating condenser $A_2$ and a first flashlight tube $A_3$, a second flashlight lamp comprising trigger $B_1$, an illuminating condenser $B_2$ and a second flashlight tube $B_3$, and one or more similary flashlight lamp units are connected in parallel.

Figure 5:
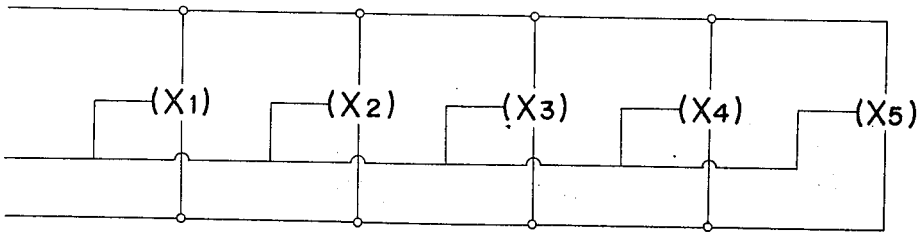
FIG. 5 is a view illustrating the state where five flash lamp units are connected in parallel.
Figure 3:
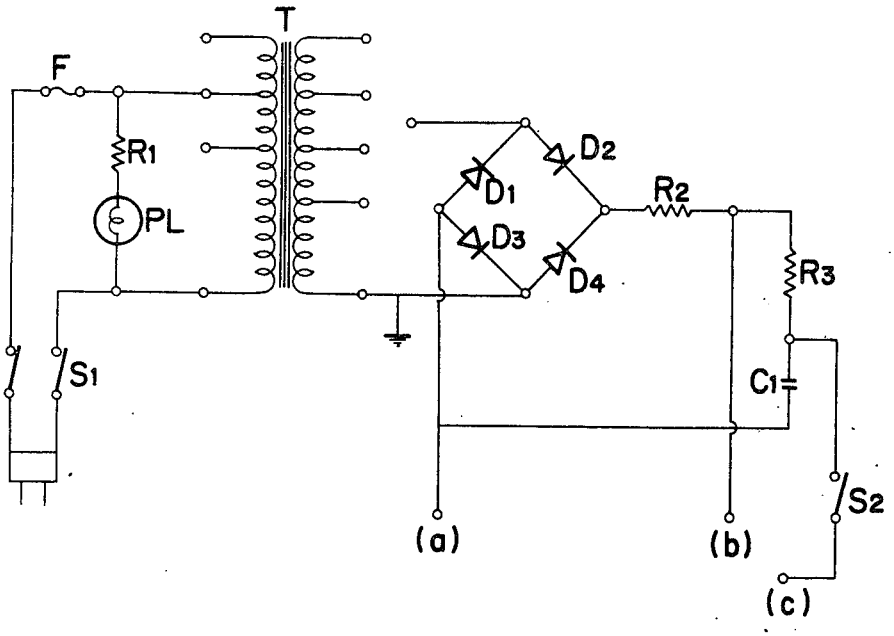
FIG. 3 is a diagram showing a part of the system of FIG. 1 in detail.
Figure 4:
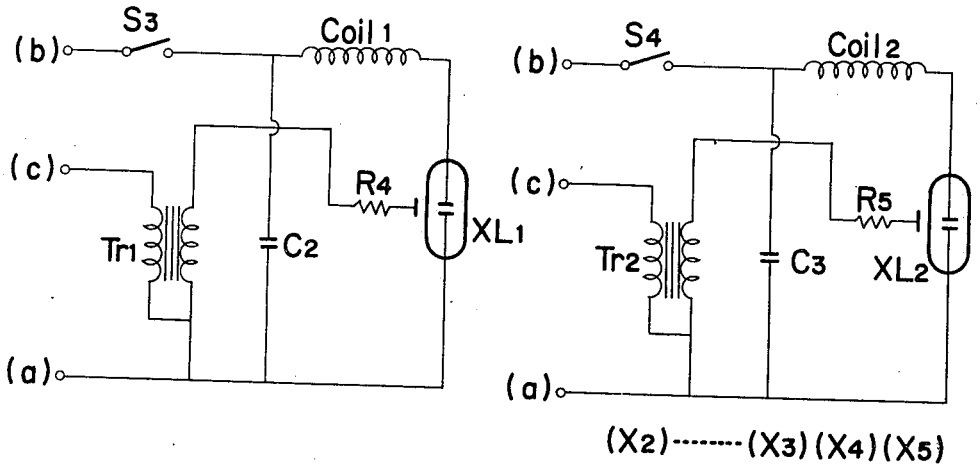
FIG. 4 is a circuit diagram of the flash lamp unit.

In the free radical photographic system of this invention, such flashlight lamp unit is excited by the exciting condenser $C_1$ to cause the lamp to emit a flash necessary for acomplishing the instantaneous printing, The circuit extending from the electric source to this exciting condenser $C_1$ is illustrated detailedly in FIG. 3. FIG. 4 shows a circuit of the illuminating condenser and trigger coil in each flash lamp unit. An instance of the multi-unit system in which five flash lamp units are connected in parallel is diagrammatically illustrated in FIG. 5 in which $X_1$ to $X_5$ show flash lamps.

When the present photosensitive composition is, according to this invention, exposed to a light flash through an original, much better results can be obtained than in the case of light exposure to the continuous radiation type. This fact will now be illustrated by reference to the following comparative test.

1. PREPARATION OF PHOTOSENSITIVE MATERIAL FOR FREE RADICAL PHOTOGRAPHY:

A photosensitive liquid of a composition shown in Table 1 was prepared, and it was coated on a polyethylene terephthalate film having a thickness of 100 $\mu$ in an amount of 100 cc/m$^2$. Then, the coated film was dried to obtain a photosensitive material.

Table 1

| Component | Amount |
|---|---|
| N,N'-diphenyl-p-phenylene diamine | 0.15 mole |
| $CBr_4$ | 0.15 mole |
| polystyrene | 100 g. |
| tetrahydrofuran | 0.4 liter |
| benzene | 0.6 liter |

2. LIGHT EXPOSURE AND FIXATION:

The light exposure tests were conducted by employing various xenon light flash sources differing in flashing time, and a xenon light source of the continuous radiation type. The light quantity was adjusted by changing the distance between the light source and the photosensitive material. The light-exposed photosensitive material was then thermally fixed for about 3 minutes in a thermostat air chamber maintained at 120°C.

3. RESULTS:

a. Influence of Flashing Time:

A testing standard negative film having a density gradient was put on the photosensitive material as prepared in 1. above, and light-exposed by using various xenon flash lamps differing in the flashing time while adjusting the light quantity to 100 millijoules per square centimeter by changing the irradiation distance between the light source and the photosensitive material, whereupon the thermal fixation was conducted in the manner as described in 2. above.

Results obtained are shown in Table 2.

Table 2

| | Flashing Time | | | | |
|---|---|---|---|---|---|
| | 10 seconds (continuous radiation) | 10 milli-seconds | 1 milli-second | 0.1 milli-second | 0.05 milli-second |
| Maximum Density (Dmax) | 0.63 | 0.98 | 1.5 | 1.6 | 1.6 |
| Contrast ($\gamma$) | 0.41 | 0.63 | 0.78 | 0.80 | 0.69 |
| Amount of Fog (Do) | 0.07 | 0.06 | 0.04 | 0.04 | 0.04 |

b. Influence of Light Quantity:

A negative film having an image of a man's figure was put on the photosensitive material and light-exposed with use of a xenon light flash source having a flashing time of 1 millisecond while varying the light quantity by changing the irradiation distance. As a result, it was found that an optimum image was obtained when the light quantity was 50 to 100 millijoules pre square centimeter. If the light quantity was lower than 5 millijoules per square centimeter, a sufficient image could not be reproduced. When the light quantity was over 500 millijoules per square centimeter, over-exposure was brought about and high-light portion was disfigured with changes in the color tone.

As is apparent from the foregoing test results, when the free radical photosensitive composition of this invention is employed, with exposure to a flash of light for a specifically-determined very short time, much better results can be obtained than in the case of the exposure to continuous radiation of light. This fact shows that, as opposed to the conventional silver salt type photosensitive material utilizing ionic reaction wherein the reciprocity law failure is brought about when the intensity of the light source is extremely high and the photographic porperties are degraded, the free radical photosensitive material of this invention utilizing the radical chain reaction has such heretofore unknown advantageous effect that excellent photographic properties can be obtained when the light exposure is performed instantaneously with use of a light flash source of a high intensity. In general, when a free radical photosensitive composition is exposed to a light emitted from a light source of the continuous radiation type, free radicals are formed by the action of light and they react with a color former to give a colored image. In this instance, oxygen and other impurities present in the system cause a reverse reaction and the image-forming reaction is inhibited by this reverse reaction. However, if the light exposure is conducted with use of a light flash source according to this invention, the above inhibiting reverse reaction is prevented from ocurring since the intended color-forming reaction is accomplished instantaneouly upon irradiation with a flash of light.

As described, according to this invention, not only the operation time is shortened but also the treatment process steps is simplified and a clear image excellent in photographic properties such as gradient, resolving power, image stability, fog amount and contrast can be easily obtained.

By the term "flashing time" used in the instant specification and claims is meant the so-called half value determined by examining the relation between the intensity and time with respect to a light emitted from a xenon flash lamp and calculating the period between the two time points when the light intensity is ½ of the highest intensity of light.

The light energy emitted from a xenon flash lamp is distributed in a broad range of from the infrared region to the ultraviolet region. Accordingly, in view of the photosensitive wavelength characteristics of the photosensitive composition it is not reasonable to express the quantity of light as the total quantity covering such broad range. Therefore, in the instant specification and claims, the light quantity is expressed by the quantity of rays in the photosensitive wavelength region.

More specifically, since the principal photosensitive composition of this invention has a photosensitive wavelength in the range of from 300 to 450 m$\mu$, a precise actino-meter (Model IL-600 manufactured by International Light Co.) provided with a broad range UV filter (Model WB-360 manufactured by the same company) in the light-receiving zone is used for measurement and the read value is used as the value of the light quantity.

The above wavelength range is applied to the principal photosensitive composition of this invention. If the photosensitive wavelength range is changed by addition of a spectral sensitizing agent or the like, the conditions for measuring the light quantity should be modified so as to cover the modified photosensitive wavelength.

This invention will now be illustrated in more detail by reference to Examples.

EXAMPLE 1

5 percent weight and 7 percent by weight solutions of polystyrene in benzene were prepared. Then 1-(naphthylimino)-3-hydroxybutane and $CHI_3$ were added to each solution so that the concentrations of the components were 0.12 mole/liter and 0.10 mole/liter, respectively. First, the 5 percent polystyrene binder solution was coated on baryta paper and dried. Then, the 7 percent polystyrene binder solution was coated thereon and dried. The coating was conducted by using a dip coater of a large size at a coating rate of 6 m/min so that the coated thickness was about 10 $\mu$. The drying of the photosensitive liquid was conducted at a temperature of 16°C. at an air rate of 3 m/min.

After completion of the coating operation, the resulting printing paper was cut into a suitable size. A negative film of the lith-type was put closely on the printing paper, and exposed to a light flash of a quantity of 50 millijoles per square centimeter emitted on the negative film surface from a xenon light flash source of 700 W/sec for a flashing time of 1/1000 second, and then the fixation was conducted for 5 minutes in a heating drier maintained at 130°C., whereby a clear positive image of a blackish brown color was directly printed on the printing paper.

EXAMPLE 2

Photosensitive compositions were prepared in the same manner as in Exmaple 1 except that 0.08 mole/liter of N,N'-diphenyl-p-phenylene diamine was used instead of 1-($\alpha$-naphthylimino)-3-hydroxybutane and 0.10 mole/liter of $CBr_4$ was used instead of $CHI_3$. The resulting photosensitive liquids were coated and dried on baryta paper in the same manner as in Example 1. The resulting printing paper was exposed through a negative film of the lith-type to a flash light emitted from a xenon flashlight source of 400 W/sec having a circuit shown in FIG. 1 for a flashing time of 1/2000 second with a light quantity of 120 millijoules per square centimeter. Then, the exposed printing paper was heated for 3 minutes by a heating roll maintained at 130°C. to obtain a clear positive image of a blue color printed on the printing paper.

EXAMPLE 3

A Photographic base paper was surface-treated by coating a polyvinyl alcohol having an average degree of polymerization of about 800 in an amount of 1.5 g/m$^2$. Then, a photosensitive liquid of the following composition was coated on the base paper in an amount of about 80 cc per square meter under a yellow safety lamp, and dried to obtain a photosensitive material.

| Component | Amount Used |
|---|---|
| acetone | 20 cc |
| tetrahydrofuran | 80 cc |
| polyvinyl chloride | 10 g |
| p-nitro-$\alpha,\alpha,\alpha$-tribromoacetophenone | 5 g |
| 2-phenylindole | 3 g |

A negative microfilm was put on the surface of the so obtained photosensitive material and a light flash was irradiated over them from a xenon light flash source of 200 W/sec for a flashing time of 0.2 millisecond with a light quantity of 18 millijoules per square centimeter. Then the fixation was conducted by heating the exposed photosensitive material for 5 minutes by a reflection type infrared lamp of 175 W so that the surface temperature was 130°C. There was obtained a clear image of a blue color printed on the photosensitive material.

What is claimed is:

1. A method of free radical photography which comprises exposing a photosensitive composition comprising a film-forming transparent plastic, a halogen-containing organic compound capable of forming free radicals upon irradiation of light and a color former capable of reacting with the free radicals to produce color, and selected from the group consisting of an arylamine, a phenol and mixtures thereof, to a light flash with a light quantity of 5 to 500 millijoules per square centimeter for a flashing time of 0.0001 to 0.005 second through a negative or positive original to be reproduced, to thereby form a colored image instantaneously.

2. A method of free radical phtography according to claim 1, wherein the quantity of the flash of light is 50 to 100 millijoules per square centimeter.

3. A method of free radical photography according to claim 1, wherein the colored image is heated for 0.2 to 10 minutes in an atmosphere maintained at 80 to 180°C. to fix the colored image.

4. A method of free radical photography according to claim 1, wherein the flash of light is emitted from a xenon source.

5. A method of free radical photography according to claim 1, wherein the phtosensitive composition is coated on a substrate.

* * * * *